US006837611B2

(12) United States Patent
Kuo

(10) Patent No.: US 6,837,611 B2
(45) Date of Patent: Jan. 4, 2005

(54) FLUID DRIVEN AGITATOR USED IN DENSIFIED GAS CLEANING SYSTEM

(75) Inventor: Tzu-Chen Kuo, Kaohsiung (TW)

(73) Assignee: Metal Industries Research & Development Centre, Kashsiung (TW)

( * ) Notice: Subject to any disclaimer, the term of this patent is extended or adjusted under 35 U.S.C. 154(b) by 46 days.

(21) Appl. No.: 10/327,850

(22) Filed: Dec. 23, 2002

(65) Prior Publication Data

US 2003/0123324 A1 Jul. 3, 2003

(30) Foreign Application Priority Data

Dec. 28, 2001 (TW) ..... 90224464 U

(51) Int. Cl.[7] ..... B01F 7/00; B01F 15/02

(52) U.S. Cl. ..... 366/168.2; 366/195; 366/280; 134/184

(58) Field of Search ..... 366/262, 273, 366/349, 280, 168.2, 195; 34/241; 134/184

(56) References Cited

U.S. PATENT DOCUMENTS 3,736,774 A * 6/1973 Shibata ..... 68/18 R
4,944,837 A 7/1990 Nishikawa et al.
5,013,366 A 5/1991 Jackson et al.
5,068,040 A 11/1991 Jackson
5,267,455 A 12/1993 Dewees et al.
5,316,591 A 5/1994 Chao et al.
5,337,446 A 8/1994 Smith et al.
5,355,901 A 10/1994 Mielnik et al.
5,370,740 A 12/1994 Chao et al.
5,370,742 A 12/1994 Mitchell et al.
5,377,705 A 1/1995 Smith, Jr. et al.
5,401,322 A 3/1995 Marshall
5,456,759 A 10/1995 Stanford, Jr. et al.
5,522,938 A 6/1996 O'Brien
5,669,251 A 9/1997 Townsend et al.
5,881,577 A 3/1999 Sauer et al.
5,943,721 A * 8/1999 Lerette et al. ..... 68/140
6,098,430 A 8/2000 McClain et al.
6,351,973 B1 * 3/2002 McClain et al. ..... 68/140

* cited by examiner

*Primary Examiner*—Tony G. Soohoo
(74) *Attorney, Agent, or Firm*—Senniger Powers

(57) ABSTRACT

This invention relates to a fluid driven agitator used in densified gas cleaning system, which comprises a hydraulic motor mounted to a cleaning vessel of the densified gas cleaning system, wherein the hydraulic motor comprises a fluid in-port for charging the fluid into the hydraulic motor from outside of the cleaning vessel, and a fluid out-port for discharging the fluid from the hydraulic motor out of the cleaning vessel. An output shaft of the hydraulic motor can be joined to a rotatable component, such as a rotary basket or an impeller, subjecting circulation of the fluid and resulting in stirring.

9 Claims, 2 Drawing Sheets

FLUID DRIVEN AGITATOR USED IN DENSIFIED GAS CLEANING SYSTEM

BACKGROUND OF THE INVENTION

1. Field of the Invention

This invention relates to a densified gas cleaning system, more particularly, to a fluid driven agitator used in densified gas cleaning system.

2. Description of the Related Art

Most of conventional industrial cleaning processes are wet cleaning types, which use solvents, water or aqueous solutions as cleaning media with addition of detergents. However, such wet cleaning types requires a subsequent drying step. Besides, toxic contaminants and detergents are dissolved in water or solvents, which need to be treated before drainage. Nowadays, the gradually stringent provisions for environmental protection progressively ban the use of conventional solvents due to the air pollution, ozone depletion, and greenhouse effect resulted from the use of such solvents. Moreover, large consumption of fresh water and energy along with the wastewater treatment also increase the cost of cleaning.

In the past twenty years, several liquefied gases have been found owning solvent-like solubility in the supercritical state and can be used to replace the conventional solvents for use in extracting or cleaning. Among theses gases, carbon dioxide, which has advantages of environmental benign, safe, low cost, and pollution-free, is one of the most frequently used gas applied in commercialized equipments.

Densified fluid for cleaning may either be liquefied gas in its liquid state or supercritical state. Conventional auxiliary cleaning apparatus such as ultrasonic generators, nozzles, agitators, or UV radiation devices as disclosed in U.S. Pat. Nos. 5,068,040, 5,316,591, 5,370,740, 5,337,446, 5,377,705, 5,456,759, and 5,522,938 can be added to enhance the cleaning effect when using liquid phase fluids for cleaning. U.S. Pat. Nos. 4,944,837, 5,013,366, 5,267,455, 5,355,901, 5,370,742, and 5,401,322 disclose that the contaminants are dissolved and removed away from the surface of articles due to the low surface tension and strong solubility properties offered by the supercritical fluids.

The conventional densified gas (such as supercritical or liquid carbon dioxide) cleaning system having an agitator is often a magnetically coupled type as described in U.S. Pat. No. 5,267,455 or a penetrating shaft type as described in U.S. Pat. Nos. 5,337,446, 5,355,901, 5,377,705, and 5,881,577. A shaft of a penetrating shaft agitator penetrates a sidewall of a vessel to join a driving motor. Hence, the shaft is complicated in design to anticipate leakage prevention. Furthermore, the short life-span of a rotary seal requires periodical replacement, especially for one operated under high pressure. To avoid the defects mentioned above, a magnetically coupled agitator is applied broadly because it has the advantages of reducing labor, easily assembling, and leakage-free. On the other hand, the cost of manufacturing the magnetically coupled agitator is very high. A spraying flow type is also utilized for agitation, wherein several nozzles mounted on an inner sidewall of a pressure vessel blow towards a rotary basket along a tangent direction, as disclosed in U.S. Pat. No. 5,669,251, or blow towards a turbine wheel mounted on the rotary basket to drive rotation, as disclosed in U.S. Pat. No. 6,098,430. Although the spraying flow type has the advantages of simple structure and low cost, it can only be applied in a system with a rotary basket, but not one with a fixed basket or one without a rotary basket.

To eliminate the defects mentioned above, a fluid driven agitator used in densified gas cleaning system is provided to overcome the problems of complicated structure for preventing leakage, the short life-span of seal happened in the conventional penetrating shaft type, and the cost and difficulty in downsizing for the magnetically coupled type agitator.

SUMMARY OF THE INVENTION

The primary objective of this invention is to provide a fluid driven agitator used in densified gas cleaning system, which overcomes the problems of complicated structure for preventing leakage, the short life-span of seal happened in the conventional penetrating shaft type, and the cost and difficulty in downsizing for the magnetically coupled type agitator.

Another objective of this invention is to provide a fluid driven agitator used in densified gas cleaning system, which utilizes a hydraulic motor mounted in a cleaning vessel to replace an electric motor. The densified gas for cleaning serves as a hydraulic source. The system according to this invention provides fully leakage-free and the advantages of simple structure, small size, and low cost.

The fluid driven agitator used in densified gas cleaning system according to this invention mainly comprises a hydraulic motor mounted in a cleaning vessel, the hydraulic motor comprising a fluid in-port for charging the fluid into the hydraulic motor from outside of the cleaning vessel, and a fluid out-port for discharging the fluid from the hydraulic motor out of the cleaning vessel. An output shaft of the hydraulic motor is joined to a rotatable component, such as a rotary basket, an impeller, a paddle, or a turbine, to make the fluid circulating and stirring thereby.

In one embodiment of this invention, one or more hydraulic motors are mounted to a bottom or sidewall inside a closed and pressure enduring cleaning vessel. The hydraulic motor comprises a fluid in-port and a fluid out-port that are connected to an input hole and an output hole penetrating the sidewall via a pressure enduring metal pipe or a flexible tube, respectively. The input hole further connects to a switch valve. The switch valve is switched to a position allowing the fluid from a high pressure pump to flow into the cleaning vessel when the cleaning vessel is in need of filling the densified gases; on the other hand, the switch valve is switched to a position in connection with a pipe line connected to the input hole allowing the fluid in the high pressure pump to flow into the hydraulic motor when the rotatable component is activated. The fluid propels blades in the hydraulic motor to drive rotation of the output shaft, subjecting the impeller joined to the shaft to stir the fluid in the cleaning vessel. The fluid is discharged from the cleaning vessel through the out-port of the hydraulic motor and the output hole, and then recycled after flowing through a filter to remove impurities and back to a densified gas storage vessel. Because the fluid pressure of the high pressure pump is higher than that of the storage vessel, a flow is produced. A flow control valve is provided between the switch valve and the input hole to control the flow rate thereby regulating the running speed of the hydraulic motor. Moreover, two switching valves may be provided to the upstream of the input hole and the output hole, respectively, for changing the incoming and outgoing directions of the fluid, so as to allow reverse operation of the hydraulic motor and result in bi-directional stirring.

According to another embodiment of this invention, the output shaft of the hydraulic motor is connected to a rotary basket, for driving rotation of the rotary basket and stirring articles in the rotary basket thereby enhancing the cleaning effects. In still another embodiment of this invention, a rotary rod suitable for cleaning delicate articles can also be connected to the output shaft, which can be provided with protrusions similar to an agitator commonly found in a washing machine for twisting and kneading purpose. In another embodiment of this invention, a particular holder is provided to the rotary rod for fixing the articles to be treated thereby preventing damages resulted from agitation and collision.

The structures and characteristics of this invention can be realized by referring to the appended drawings and explanations of the preferred embodiments.

The following Examples are given for the purpose of illustration only and are not intended to limit the scope of this invention.

DETAILED DESCRIPTION OF THE INVENTION

According to this invention, the densified gas cleaning system uses dense phase fluids that consist of low surface tension and strong solubility properties, as cleaning media to dissolve contaminants and bring them away from the surface of articles for cleaning purpose. The dense phase fluids according to this invention can be transformed to supercritical fluids or to liquefied gases, at a temperature and pressure that does not change the physical and chemical properties of the articles to be treated. Such gases typically comprise but are not limited to (1) hydrocarbons, such as methane, ethane, propane, butane, pentane, hexane, ethylene, and propylene; (2) halogenated hydrocarbons, such as tetrafluoromethane, cholodifluoromethane, sulfur hexafluoride, perfluoropropane; (3) inorganics, such as carbon dioxide, ammonia, helium, argon, krypton, xenon, and nitrous oxide; and (4) the mixtures thereof. The dense phase fluids for removing a particular contaminant should be selected to have solubility properties similar to those of the target contaminant. For example, for dissolving a contaminant with cohesion forces mainly consisted of hydrogen bonds, the dense phase fluids having at least equivalent hydrogen bonding ability should be selected.

Preferably, the dense phase fluid used in the low cost liquefied gas cleaning system according to this invention is carbon dioxide because carbon dioxide is cheap, non-toxic, and easily liquefied. This invention takes carbon dioxide as a preferred embodiment for illustration. However, artists skilled in the field can choose any suitable dense phase fluids mentioned above according to the properties of the articles to be treated. Hence, the dense phase fluid according to this invention is not limited to carbon dioxide, and the proper dense phase fluid mentioned above can all be applied to this invention.

Figure 1:
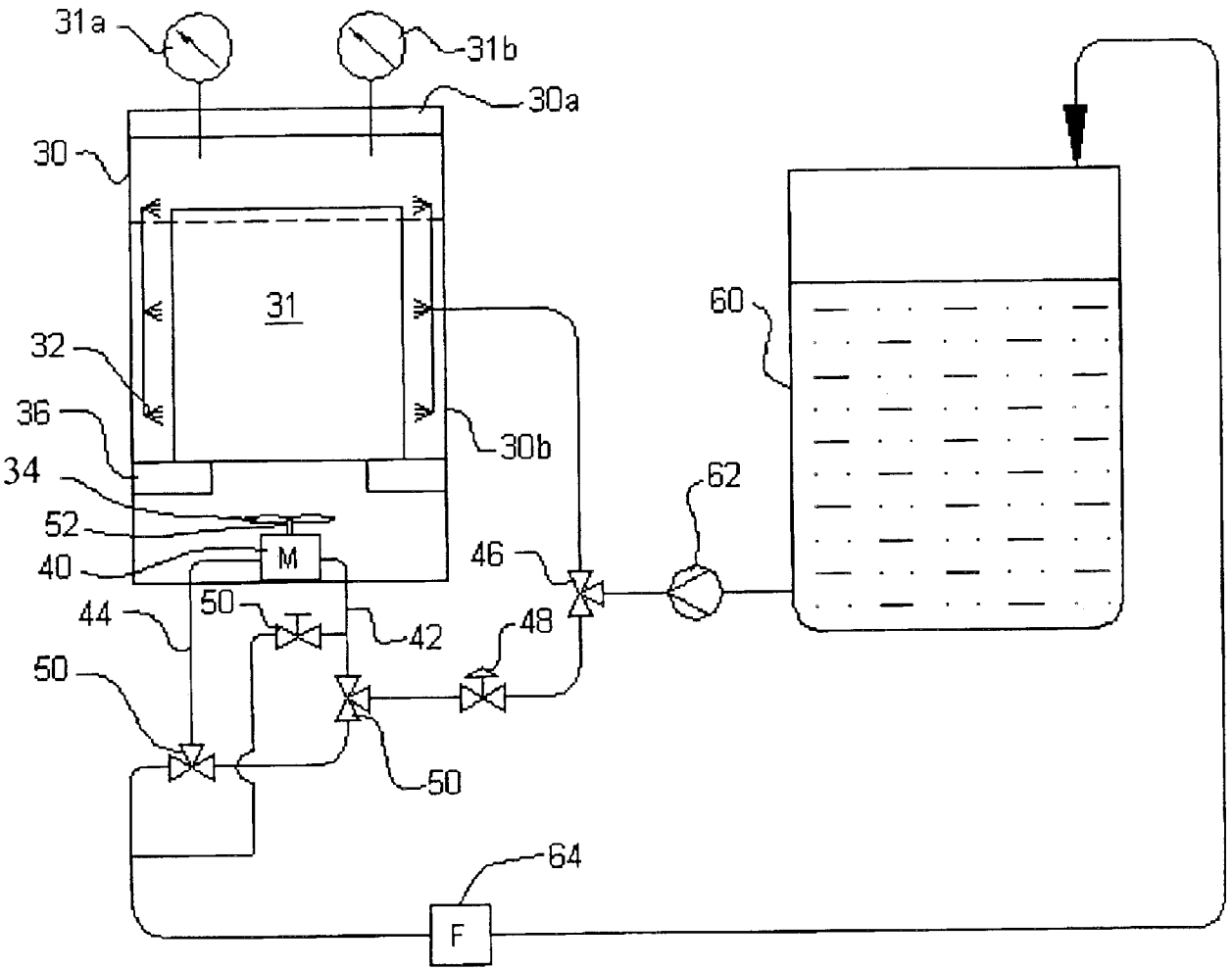
FIG. 1 illustrates a fluid driven agitator used in densified gas cleaning system according to one embodiment of this invention.

FIG. 1 illustrates a fluid driven agitator used in densified gas cleaning system according to this invention. The densified gas cleaning system comprises a cleaning vessel 30 having a bottom 30*a* and a sidewall 30*b* jointly defining a cleaning chamber 31. The cleaning chamber 31 comprises a temperature sensor 31*a* for sensing the temperature of the cleaning camber 31 and a pressure sensor 31*b* for sensing the pressure of the cleaning chamber 31. Nozzles 32 mounted along the sidewall 30*b* supply the cleaning chamber 31 with carbon dioxide for spraying and cleaning the articles to be treated. Preferably, the nozzles 32 are mounted along a tangent direction of the sidewall 30*b* subjecting the carbon dioxide supplied to the cleaning chamber 31 to form a vortex. An UV radiation can be also mounted to the cleaning vessel 30 for sterilization. Preferably, a basket 35 supported in a proper position in the cleaning chamber 31 by a basket support 35 is provided, into which basket 35 the articles to be treated are placed.

The characteristic of this invention resides in that, one or more hydraulic motors 40 are provided to the bottom or sidewall inside the cleaning vessel 30. The hydraulic motor 40 comprises a fluid in-port 42 and a fluid out-port 44 which connect to an input hole and an output hole penetrating the sidewall via a pressure enduring metal pipe or a flexible tube, respectively. The in-port 42 further connects to a switch valve 46. The switch valve 46 is switched to a position allowing the fluid from a high pressure pump 62 to flow into the cleaning vessel 30 when the cleaning vessel 30 is in need of filling the densified gas; on the other hand, the switch valve 46 is switched to a position in connection with a pipe line connected to the in-port 42, allowing the fluid in the high pressure pump 62 to flow into the hydraulic motor 40 when a rotatable component 34 is activated. The fluid propels blades in the hydraulic motor 40 to drive rotation of an output shaft 52, subjecting an impeller 54 joined to the shaft to stir the fluid in the cleaning vessel 30. The fluid is discharged from the cleaning vessel 30 through the out-port 44 of the hydraulic motor 40, and then recycled after flowing through a filter 64 to remove impurities and back to the densified gas storage vessel 60. Because the fluid pressure of the high pressure pump 62 is higher than that of the storage vessel 60, a flow is produced. A flow control valve 48 is provided between the switch valve 46 and the input hole to control the flow rate thereby regulating the running speed of the hydraulic motor 40. Moreover, two switching valves 50 may be provided to the upstream of the input hole and the output hole, respectively, for changing the incoming and outgoing directions of the fluid, so as to allow reverse operation of the hydraulic motor 40 and result in bi-directional stirring.

Figure 2:
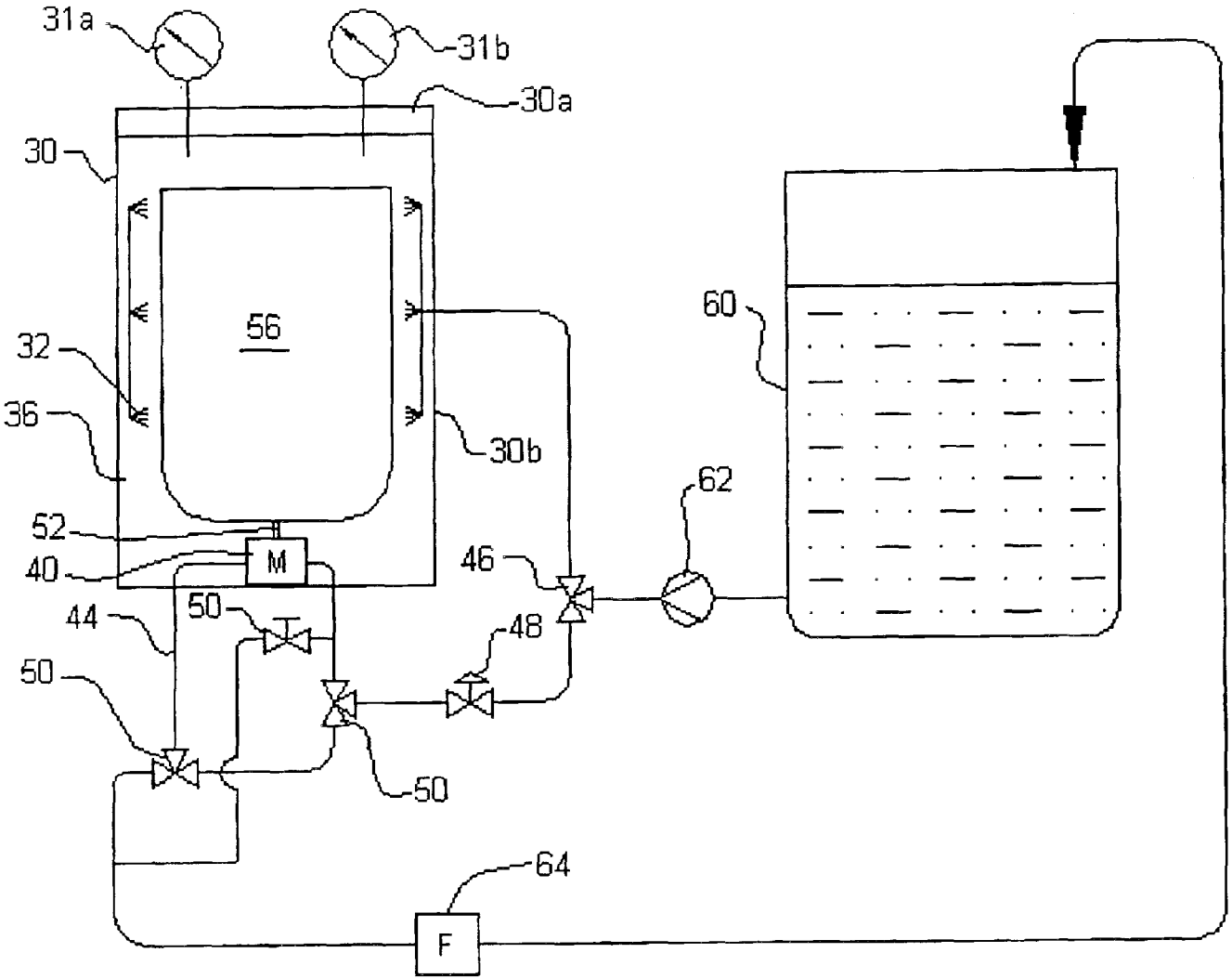
FIG. 2 illustrates a fluid driven agitator used in densified gas cleaning system according to another embodiment of this invention.

As shown in FIG. 2, according to another embodiment of this invention, the output shaft 52 of the hydraulic motor 40 is connected to a rotary basket 56, for driving rotation of the rotary basket 56 and stirring articles in the rotary basket 56 thereby enhancing the cleaning effects.

In still another embodiment of this invention, a rotary rod (not shown) suitable for cleaning delicate articles can also be connected to the output shaft 52, which can be provided with protrusions similar to those of an agitator commonly found in a washing machine for twisting and kneading purpose.

In another embodiment of this invention, a particular holder (not shown) may be provided to the rotary rod for fixing the articles to be treated thereby preventing damages resulted from agitation and collision.

The rotatable component 34 according to this invention can be an impeller type, a worm type, a blade type, a rod type, a cogwheel type, or a basket type.

The advantages of the agitator used in densified gas cleaning system according to this invention include the followings:

(a) Elimination of a shaft penetrating the vessel eliminates the need of leakage-proof design under high pressure for moving articles.

(b) The provision of a hydraulic motor for replacing an electric motor provides a larger ratio of torsion/volume than the conventional, magnetically coupled type, with a smaller volume and at a low cost.

(c) The fluid used for driving is the densified (liquefied or supercritical state) gas used in the system. After the densified gas fill up the cleaning vessel, the fluid is switched to flow into the hydraulic motor to drive rotation of the rotatable component without needing an additional power source (such as electric power or hydraulic fluid).

(d) The risk of pollution is eliminated because the same fluids are used inside and outside the hydraulic motor.

(e) The flow rate of the fluid is controlled by the flow control valve so as to allow regulation of the running speed of the hydraulic motor.

(f) The system can be adapted to a cleaning vessel with or without a rotary basket. When the system is equipped with the rotary basket, the output shaft of the hydraulic motor is joined to the rotary basket for driving the rotary basket. However, when the system is not equipped with a rotary basket or implements a fixed basket, the output shaft of the hydraulic motor is joined to a impeller for driving the impeller.

While several embodiments of this invention have been illustrated and described, various modifications and improvements can be made by those skilled in the art. The embodiments of this invention are therefore described in an illustrative but not restrictive sense. It is intended that this invention may not be limited to the particular forms as illustrated, and that all modifications which maintain the spirit and scope of this invention are within the scope as defined in the appended claims.

What is claimed is:

1. A fluid driven agitator used in densified gas cleaning system, which comprises:

a hydraulic motor mounted in a cleaning vessel of the densified gas cleaning system;

a fluid in-port for charging the fluid into the hydraulic motor from an outside of the cleaning vessel;

a fluid out-port for discharging the fluid from the hydraulic motor out of the cleaning vessel; and a rotatable component joined to an output shaft of the hydraulic motor subjecting circulation of the fluid.

2. The fluid driven agitator according to claim 1, wherein the fluid is a gas in its liquefied state.

3. The fluid driven agitator according to claim 1, wherein the fluid is in a supercritical state.

4. The fluid driven agitator according to claim 1, wherein the fluid is carbon dioxide in its liquefied state.

5. The fluid driven agitator according to claim 1, wherein the fluid in-port connects the hydraulic motor and a sidewall of the cleaning vessel, so as to allow the fluid to pass through the sidewall of the cleaning vessel and to be charged into the hydraulic motor.

6. The fluid driven agitator according to claim 1, wherein the fluid out-port connects the hydraulic motor and a sidewall of the cleaning vessel, so as to allow the fluid in the hydraulic motor to pass through the sidewall of the cleaning vessel and to be discharged from the hydraulic motor.

7. The fluid driven agitator according to claim 1, wherein the rotatable component is selected from the group consisting of: an impeller type, a worm type, a blade type, a rod type, a cogwheel type, and a basket type.

8. The fluid driven agitator according to claim 1, wherein a switch valve is provided to the fluid in-port that is switched to a position in connection with a pipe line connected to the in-port allowing the fluid in a high pressure pump to flow into the hydraulic motor when the rotatable component is activated.

9. The fluid driven agitator according to claim 1, wherein flow control valves are provided to the fluid in-port and fluid out-port for regulating the running speed of the hydraulic motor.

* * * * *